United States Patent [19]

Miers

[11] 4,008,974

[45] * Feb. 22, 1977

[54] SEALING MEMBER

[75] Inventor: John Aubrey Miers, Woodford Green, England

[73] Assignee: L. J. A. Miers (Exports) Limited, Woodford Green, England

[ * ] Notice: The portion of the term of this patent subsequent to July 6, 1993, has been disclaimed.

[22] Filed: Apr. 21, 1976

[21] Appl. No.: 679,132

Related U.S. Application Data

[63] Continuation of Ser. No. 527,867, Nov. 27, 1974, Pat. No. 3,967,911.

[30] Foreign Application Priority Data

Nov. 28, 1973 United Kingdom ..... 55173/73

[52] U.S. Cl. ..... 404/48

[51] Int. Cl.[2] ..... E01C 11/02

[58] Field of Search ..... 404/48, 47, 69, 68, 404/74

[56] References Cited

UNITED STATES PATENTS

| | | | |
|---|---|---|---|
| 1,089,943 | 3/1914 | Morse | 404/69 |
| 3,180,238 | 4/1965 | Crone | 404/48 X |
| 3,255,680 | 6/1966 | Cooper | 404/68 X |
| 3,276,335 | 10/1966 | Middlestadt | 404/48 |
| 3,324,775 | 6/1967 | Crone | 404/65 X |
| 3,363,383 | 1/1968 | LaBarge | 404/68 X |
| 3,413,900 | 12/1968 | Crone | 404/48 |
| 3,508,369 | 4/1970 | Tennison | 404/69 X |
| 3,603,055 | 9/1971 | Dale | 404/65 X |
| 3,782,846 | 1/1974 | Johnson | 404/48 |
| 3,838,930 | 10/1974 | Koch | 404/48 |

*Primary Examiner*—Nile C. Byers, Jr.
*Attorney, Agent, or Firm*—Michael J. Striker

[57] ABSTRACT

The invention relates to a two-part insertion member for use in the production of contraction or warping joints in continuously laid concrete slabs. The insertion member comprises a rigid lower part (to act as crack-inducing fillet) and a flexible upper part (to act as a sealing member) connected together, the lower part including an upstanding section which extends close to the uppermost extremity of the member. The invention also includes a method of forming sealed joints in concrete slabs.

6 Claims, 7 Drawing Figures

SEALING MEMBER

Figure 1:
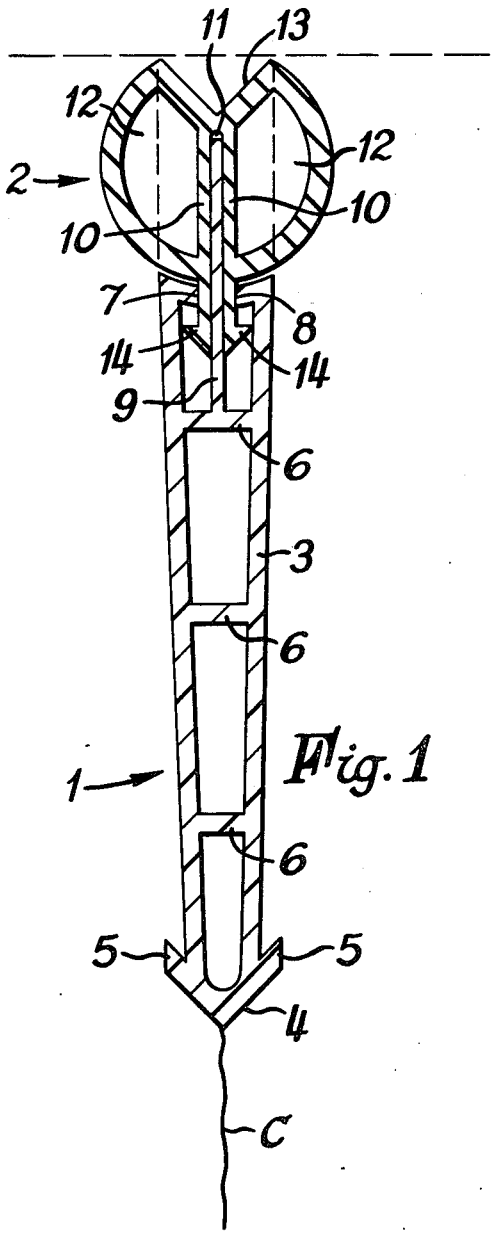

This is a continuation, of application Ser. No. 527,867, filed Nov. 27, 1974, now U.S. Pat. No. 3,967,911.

This invention relates to the production of contraction or warping joints in continuously laid concrete slabs, such as roads, vehicle parks or aircraft runways and hard standing areas, and in particular to an improved insertion member for such joints and to a method of forming such joints.

It is known that controlled separation of slabs in a continuously laid mass of concrete, to allow for relative movement between the slabs, can be achieved by locating insertion members (so-called "crack-inducing fillets") at spaced-apart intervals in the mass of wet concrete. It is also known that these crack-inducing fillets can be shaped to leave a groove in the concrete adjacent to the upper surface of the mass when they are subsequently removed from the hardened concrete. To prevent the ingress of water and/or incompressible foreign matter such as stones into such grooves, it is known to locate a sealing material (e.g. a hollow elastomeric strip) in the grooves.

However, these known methods for producing a sealed joint involve several operations (inserting the fillet into the wet mass, removing it from the hardened concrete, cleaning out the groove and inserting the sealing material) and it would be easier and very much cheaper if all the operations could be combined into one. Several attempts have been made to provide a combined crack-inducing fillet and joint sealer, but the problem is that for use with modern concrete laying equipment the fillet needs to be rigid (to allow it to be pushed - with or without vibration - into the wet concrete and, subsequently withstand the pressures and attrition of finishing devices used to surface the mass) whilst the sealing material, has to be flexible and resilient.

This invention relates to the use of a rigid crack-inducing fillet combined with an elastomeric seal whereby the crack-inducing, groove-forming and sealing can be performed in one operation with no further work necessary, (except optionally the admission of air into an evacuated resilient hollow section).

According to one aspect of the present invention an insertion member for use in the construction of concrete slabs comprises a first elongated part of rigid material and a second elongated part of flexible resilient compressible material connected together in the elongate direction thereof, so in that the first part of rigid material defines the lower extremity of the member, the second part of flexible resilient compressible material defines the upper extremity of the member and, a section of the first part extends to a position close to the uppermost extremity of the member.

Conveniently the first part has a body portion of generally tapered cross-section (normal to its elongate direction), the lowermost extremity of the body portion being shaped to facilitate its insertion into wet concrete. The first part conveniently exhibits outwardly projecting ribs which provide a key in the concrete and prevent subsequent removal of the first member from the concrete after the latter has hardened even when a gap forms between the slabs. The section of the first part which extends close to the uppermost extremity of the member is suitably a narrow web which is surrounded by pieces of the second part when the two parts are connected together.

The second part conveniently has an upper extremity which defines a Vee-groove and suitably comprises a hollow volume on each side of a central, bifurcated web. The lower extremity of the web may be provided with outwardly extending ribs adapted to provide a locking engagement in slits formed in the first part. Alternatively the second part may be adhesively secured to the first part.

According to a further aspect of the invention a method of forming a sealed joint between two adjacent slabs of concrete comprises pressing an insertion member into a mass of wet concrete to form a groove between the slabs and locating resilient sealing material in the groove, the insertion member is formed by connecting together a rigid lower part and a resilient upper part having at least one hollow volume therein so that a rigid projection of the lower part extends close to the upper extremity of the upper part, evacuating the or each hollow volume to collapse the upper part, pressing the insertion member, rigid part first, into the wet mass at the desired location of the joint to leave the upper extremity of the member flush with or just below the upper surface of the mass and, when the concrete has hardened, expanding the or each hollow volume within the groove formed between the slabs.

Figure 3:
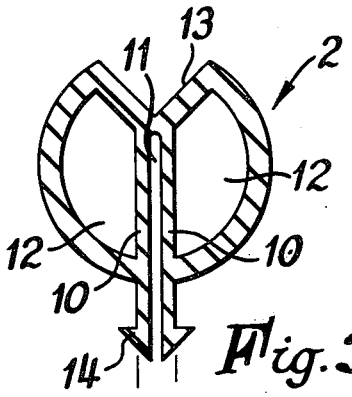
Figure 2:
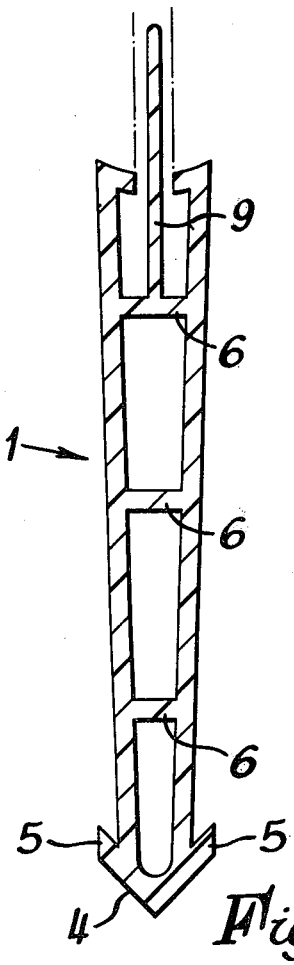
Figure 4:
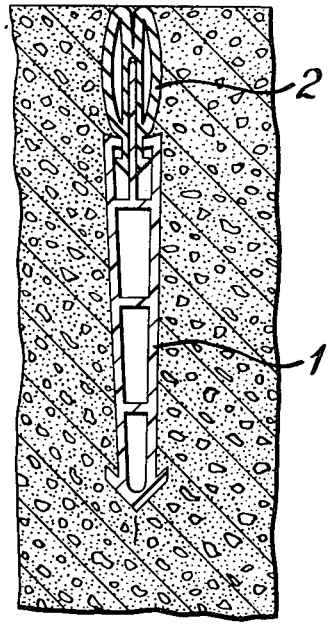
Figure 5:
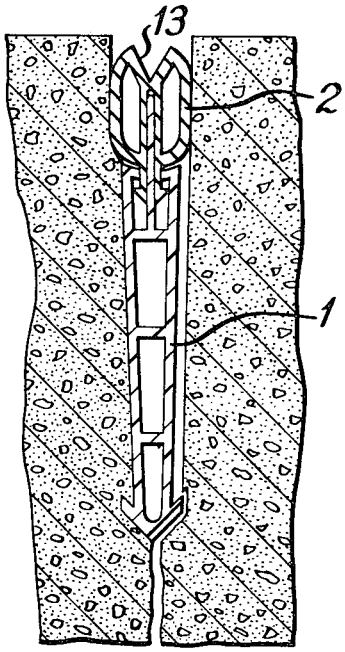
Figure 6:
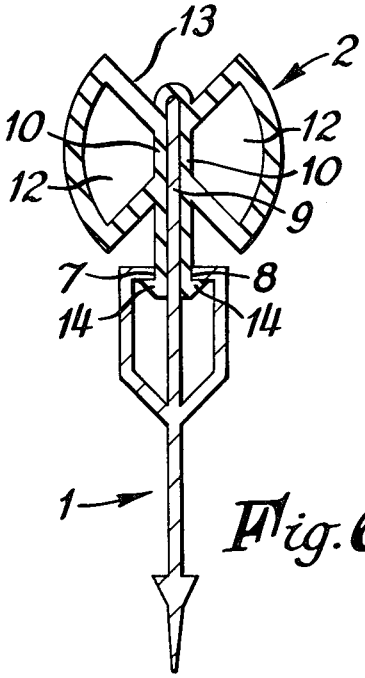
Figure 7:
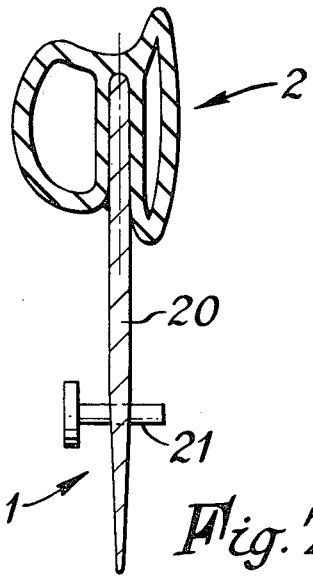

Embodiments of insertion members in accordance with the invention and the method in which they are used will now be described, by way of example, with reference to the accompanying drawings, in which FIG. 1 is a side elevation of a first embodiment of insertion member in its assembled condition, FIGS. 2 and 3 show the components of the member of FIG. 1 prior to assembly, FIGS. 4 and 5 show the insertion member located within a roadway just after insertion and after a period of use, respectively, and FIGS. 6 and 7 show two modified designs of insertion members.

In FIG. 1 of the drawing the insertion member is shown in cross-section and would normally be many meters long (i.e. in the direction normal to the plane of the drawing). The insertion member comprises a rigid first part 1 (shown separately in FIG. 2) and a flexible, resilient second part 2 (shown separately in FIG. 3) connected thereto.

The first part 1 comprises a body portion 3 which tapers outwardly in the upward direction from a lowermost foot 4. The foot 4 defines ribs 5 which project outwardly from the body portion to an extent comparable to the overall width of the upper end of the body portion 3. The first part 1 is fabricated by extrusion from a rigid plastics material (e.g. P.V.C.) and is internally stiffened by transverse ribs 6. The ribs 6 may be extended outwardly to provide additional keys in the concrete.

The upper end of the body portion 3 is provided with two slits 7 and 8 extending lengthwise thereof, each slit being delimited on its inner side by a stiffening web 9 which projects above the top of the body portion 3.

The second part 2 is an elastomeric extrusion and is of a shape generally known as a "tulip section". The second part 2 comprises a bifurcated central web 10 defining a channel 11 in which the stiffening web 9 of the first part is located when the two parts 1 and 2 are assembled together. Hollow Dee sections 12 are defined on each side of the central web 10 and these Dee sections together define a Vee-groove 13 at the uppermost extremity of the member.

To prevent removal of the part 2 from the part 1, the lower ends of the split web 10 are each provided with an outwardly extending rib 14, these ribs being shaped to facilitate insertion downwardly through the slits 7 and 8 but to make upward removal subsequent to insertion very difficult.

The embodiment shown in FIG. 1 has an overall height between the foot 4 and the Vee-groove 13 of approximately 8 centimeters but other sizes are clearly possible, the size required depending inter alia on the thickness of the concrete mass being laid.

To employ the insertion member shown in FIG. 1 it needs to be located in a wet mass of concrete. One method of achieving such insertion involves taking the required length (e.g. up to about 10 meters) of the combined member, attaching it to a conventional joint cutting blade and vibrating it down into the mass of wet concrete through the upper surface with the foot 4 entering the concrete mass first. Prior to insertion, the sections 12 are collapsed by removing air from them and the thrust necessary for insertion is applied to the web 9 via the collapsed sections 12. This gives the condition shown in FIG. 4.

An alternative method of insertion involves vibrating the joint cutting blade into the wet concrete mass (to remove any large aggregate particles from the insertion line) and then, as soon as possible after removing the blade, pressing the combined member (with or without vibration) into the region vacated by the blade.

The close proximity of the upper end of the stiffening web 9 to the top of the flexible part 2 enables the necessary downward thrust to be safely applied to the member during this insertion procedure. Insertion is continued until the upper surface of the member is flush with or just below the upper surface of the concrete mass. Surface treatment of the concrete mass can then be effected and the mass left to harden. As it hardens the first part 1 causes a crack to develop below the foot 4 (e.g. as shown by the line 'C' in FIG. 1).

The firm anchoring of the collapsed flexible second part onto the rigid first part and the rigidity imparted to the second part by the stiffening web 9 ensures that the flexible second part remains securely in position during the final surface treatment of the mass. The Dee sections 12 can be evacuated of air immediately prior to insertion and the ends sealed or the member can be supplied with the second part in this condition. In either case the Dee sections are in a collapsed condition within the gap defined in the concrete mass as it hardens. After the concrete has hardened the air is allowed back into the Dee sections to allow them to accommodate movement between the slabs (see FIG. 5).

It will be appreciated that many variations can be made to the actual shapes of the first and second parts without departing from the scope of the invention as defined in the following claims.

FIG. 6 shows a further embodiment, using a differently shaped section for the rigid part 1. Similar reference numerals have been used in FIG. 6 as were used in FIG. 1 where these refer to similar integers.

FIG. 7 shows a still further embodiment in which the rigid first part 1 is a plate 20 (e.g. of wood, plastics or metal) provided with transverse keying pegs 21 at intervals therealong. The second part 2 (shown collapsed on the right and expanded on the left) is a hollow section elastomeric strip which is merely stuck to the upper edge of the plate 20 with a suitable adhesive.

What is claimed is:

1. An insertion member for use in the construction of concrete slabs, comprising a first elongated element of rigid synthetic plastic material having an upper and a lower portion each extending longitudinally of said first element, said first element diverging in direction from said lower to said upper portion, said upper portion being formed with shoulder region and with an upstanding reinforcing plate extending upwardly beyond said shoulder region, said plate being separated from said shoulder region by a pair of slits extending longitudinally of said first element; and a second elongated element of resiliently yieldable material including a bifurcated web extending longitudinally of said second element and having a top end and a pair of limbs extending downwardly from said top end and each having a lower end formed with a laterally extending rib, and a pair of hollow sections laterally flanking said web adjacent said top end thereof, said first and second elements being so connected that said second element straddles said reinforcing plate of said first element and said ribs of said limbs are received in said slits, respectively, so that said plate extends toward the uppermost part of the insertion member and so that, when said hollow sections are evacuated and collapsed against said reinforcing plate for insertion of the insertion member between the slabs, said reinforcing plate reinforces said hollow sections and said shoulder region protects the same from below during said insertion.

2. An insertion member as defined in claim 1, wherein said lower portion of said first element is formed with a tapered foot having laterally projecting ribs the width of which substantially corresponds to the width of said shoulder region of said first element.

3. An insertion member as defined in claim 1, wherein said shoulder region is formed with hollow regions respectively communicating with said slits, said hollow regions being located at opposite sides of said first element and separated by said reinforcing plate.

4. An insertion member as defined in claim 3, wherein said ribs of said limbs diverge laterally of said web in direction toward said hollow sections.

5. A method of providing a sealed joint between two adjacent slabs of concrete, comprising the steps of forming a first elongated element of rigid material with a shoulder region, a reinforcing portion, and two slits separating the latter from the shoulder region; forming a second elongated element of resiliently yieldable material with a bifurcated web having a pair of limbs and with a pair of hollow sections laterally flanking the web; assembling the first and second elements so that the reinforcing portion is received between the limbs and the latter are respectively accommodated in the slits to thereby obtain a unitary insertion member; evacuating the hollow sections of the second element to collapse the same; pressing the insertion member, the rigid first element first, into a mass of wet concrete to form a groove between the slabs when the insertion member is completely located below the upper surface of the mass, the reinforcing portion of the first element reinforcing, and the shoulder region of the first element protecting, the second element during the pressing step; and expanding the hollow sections within the groove between the slabs subsequent to hardening of the concrete to thereby seal the groove.

6. A method as defined in claim 5, and further comprising the step of attaching the insertion member to a joint-cutting blade; and wherein said pressing step includes vibrating the joint-cutting blade with the insertion member attached thereto to thereby gradually introduce the latter into the mass.

* * * * *